US007100591B2

(12) United States Patent
Terry

(10) Patent No.: US 7,100,591 B2
(45) Date of Patent: Sep. 5, 2006

(54) ARROW REST FOR AN ARCHERY BOW

(76) Inventor: Edgell Terry, 1115 Shady La., Rome City, IN (US) 46784

( * ) Notice: Subject to any disclaimer, the term of this patent is extended or adjusted under 35 U.S.C. 154(b) by 0 days.

(21) Appl. No.: 10/974,111

(22) Filed: Oct. 27, 2004

(65) Prior Publication Data

US 2005/0121011 A1 Jun. 9, 2005

Related U.S. Application Data

(63) Continuation-in-part of application No. 10/614,608, filed on Jul. 7, 2003, now Pat. No. 6,820,607.

(60) Provisional application No. 60/515,196, filed on Oct. 28, 2003.

(51) Int. Cl.
*F41B 5/22* (2006.01)

(52) U.S. Cl. ..... 124/44.5; 124/25.6

(58) Field of Classification Search ..... 124/24.1, 124/44.5, 25.6
See application file for complete search history.

(56) References Cited

U.S. PATENT DOCUMENTS

| | | | | |
|---|---|---|---|---|
| 4,287,868 A | | 9/1981 | Schiff | 124/44.5 |
| 4,344,409 A | | 8/1982 | Barner | 124/24.1 |
| 4,803,971 A | | 2/1989 | Fletcher | 124/44.5 |
| 4,907,566 A | | 3/1990 | Klein | 124/44.5 |
| 4,953,521 A | | 9/1990 | Troncoso et al. | 124/24.1 |
| 5,150,700 A | | 9/1992 | Troncoso | 124/44.5 |
| 5,235,958 A | | 8/1993 | Laffin | 124/44.5 |
| 5,490,492 A | * | 2/1996 | Savage | 124/44.5 |
| 5,632,263 A | * | 5/1997 | Sartain | 124/44.5 |
| 5,944,005 A | * | 8/1999 | Schiff | 124/44.5 |
| 6,595,195 B1 | | 7/2003 | Barner et al. | 124/44.5 |
| 6,913,008 B1 | * | 7/2005 | Simo et al. | 124/44.5 |

* cited by examiner

*Primary Examiner*—John A. Ricci
(74) *Attorney, Agent, or Firm*—Taylor & Aust. P.C.

(57) ABSTRACT

An archery bow includes a riser and a pair of flexible limbs extending from the riser, each limb having a distal end. At least one string extends between the limb distal ends and is movable between a drawn position and a fired position. A drop-away arrow rest mounted to the riser is movable between a raised position and a lowered position. The arrow rest is biased to the lowered position and includes a trigger sear for maintaining the arrow rest in the raised position. A cable guard arm is attached to and extends from the riser. A trigger assembly is carried by the cable guard arm and associated with the trigger sear. A trigger release is carried by and slidable along the cable guard arm. The trigger release is coupled with at least one string. The trigger release engages the trigger assembly and thereby disengages the trigger sear upon movement of the at least one string from the drawn position to the fired position.

14 Claims, 6 Drawing Sheets

ARROW REST FOR AN ARCHERY BOW

CROSS REFERENCE TO RELATED APPLICATIONS

This is a non-provisional application based upon U.S. provisional patent application Ser. No. 60/515,196, entitled "ARROW REST FOR AN ARCHERY BOW", filed Oct. 28, 2003; and a continuation-in-part of U.S. patent application Ser. No. 10/614,608, entitled "ARROW REST FOR AN ARCHERY BOW", filed Jul. 7, 2003 now U.S. Pat. No. 6,820,607.

BACKGROUND OF THE INVENTION

1. Field of the Invention

The present invention relates to archery equipment, and, more particularly, to arrow rests for archery equipment.

2. Description of the Related Art

Devices are known which provide improved accuracy for individuals target shooting and hunting with archery equipment. For example, bow sights have long been used to provide improved accuracy of an archery bow. A rear sight may be in the form of a bow string mounted peep sight having a small hole which is aligned with a forward sight pin mounted on the bow riser for substantially increasing the accuracy of the bow. As a further example, the front sight may be in the form of multiple, vertically aligned horizontal pins mounted in a frame to protect the pins. These multi-pin sights have proliferated in the last few years, especially in the hunting arena, where the distance to a target can vary as much as from 10–60 yards. Optical lenses defining a scope sight may also be used to provide improved accuracy. Yet still, it is also known to use a laser sight which is aligned at a fixed position relative to the riser of the bow to project a laser beam and ultimately a red dot onto a target.

Arrow rests of various configurations are also known for improving the accuracy of an archery bow. An arrow rest generally includes an arrow rest platform for supporting the arrow during drawing and shooting of the bow. The fletchings of the arrow are preferably oriented so as to not impact with the arrow rest platform of the arrow rest upon shooting of the bow. The arrow rest platform may be in the form of a plate or leaf with a notch formed in the distal end for supporting the arrow, or a pair of spaced apart pins which support the underside of the arrow. Other types of arrow rest platforms are also possible.

It is also known to move the arrow rest platform of an arrow rest between a raised support position and a lowered position upon shooting of the bow such that the arrow rest platform does not interfere with the free flight of the arrow. The arrow rest platform is biased to a lowered position using a spring arrangement. A rubber tube is coupled at one end with the arrow rest platform and at the other end with the bow string. Upon drawing the bow string, the rubber tube rotates the arrow rest platform to a raised position. Upon release of the bow string, the rubber tube moves from a stretched position to a relaxed position which allows the arrow rest platform to fall to the lowered position. In theory, moving the arrow rest platform to a lowered position which does not interfere with the free flight of the arrow would provide improved accuracy. However, the mechanics of this known type of design for moving the arrow rest platform to a lowered position has proved to be cumbersome and somewhat unreliable.

What is needed in the art is an arrow rest with an arrow rest platform which may be reliably moved between a raised support position and a lowered position upon shooting of an archery bow to provide improved accuracy of the archery bow.

SUMMARY OF THE INVENTION

The present invention provides an arrow rest for an archery bow including an arrow rest platform which is automatically moved to a lowered position upon shooting the bow such that the arrow rest platform does not interfere with the free flight of the arrow.

The invention comprises, in one form thereof, an archery bow including a riser and a pair of flexible limbs extending from the riser, each limb having a distal end. At least one string extends between the limb distal ends and is movable between a drawn position and a fired position. A drop-away arrow rest mounted to the riser is movable between a raised position and a lowered position. The arrow rest is biased to the lowered position and includes a trigger sear for maintaining the arrow rest in the raised position. A cable guard arm is attached to and extends from the riser. A trigger assembly is carried by the cable guard arm and associated with the trigger sear. A trigger release is carried by and slidable along the cable guard arm. The trigger release is coupled with at least one string. The trigger release engages the trigger assembly and thereby disengages the trigger sear upon movement of the at least one string from the drawn position to the fired position.

An advantage of the present invention is that the arrow rest platform is automatically accelerated to a lowered position upon shooting of the bow such that it does not interfere with the free flight of the arrow.

Yet another advantage is that the actuator which moves the second sear to the disengaged position may be configured as a rotary actuator, linear actuator, or other suitable actuator.

Yet another advantage is that the arrow support platform may be configured as a plate, pair of pins, or other suitable arrow rest platform, depending upon the particular configuration.

Still another advantage is that the acceleration rate of the arrow rest platform between the raised support position and the lowered position may be adjusted depending upon the characteristics and attachment locations of the spring.

A further advantage is that the timing of the disengagement of the trigger sear can be adjusted.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplification is not to be construed as limiting the scope of the invention in any manner.

DETAILED DESCRIPTION OF THE INVENTION

Figure 1:
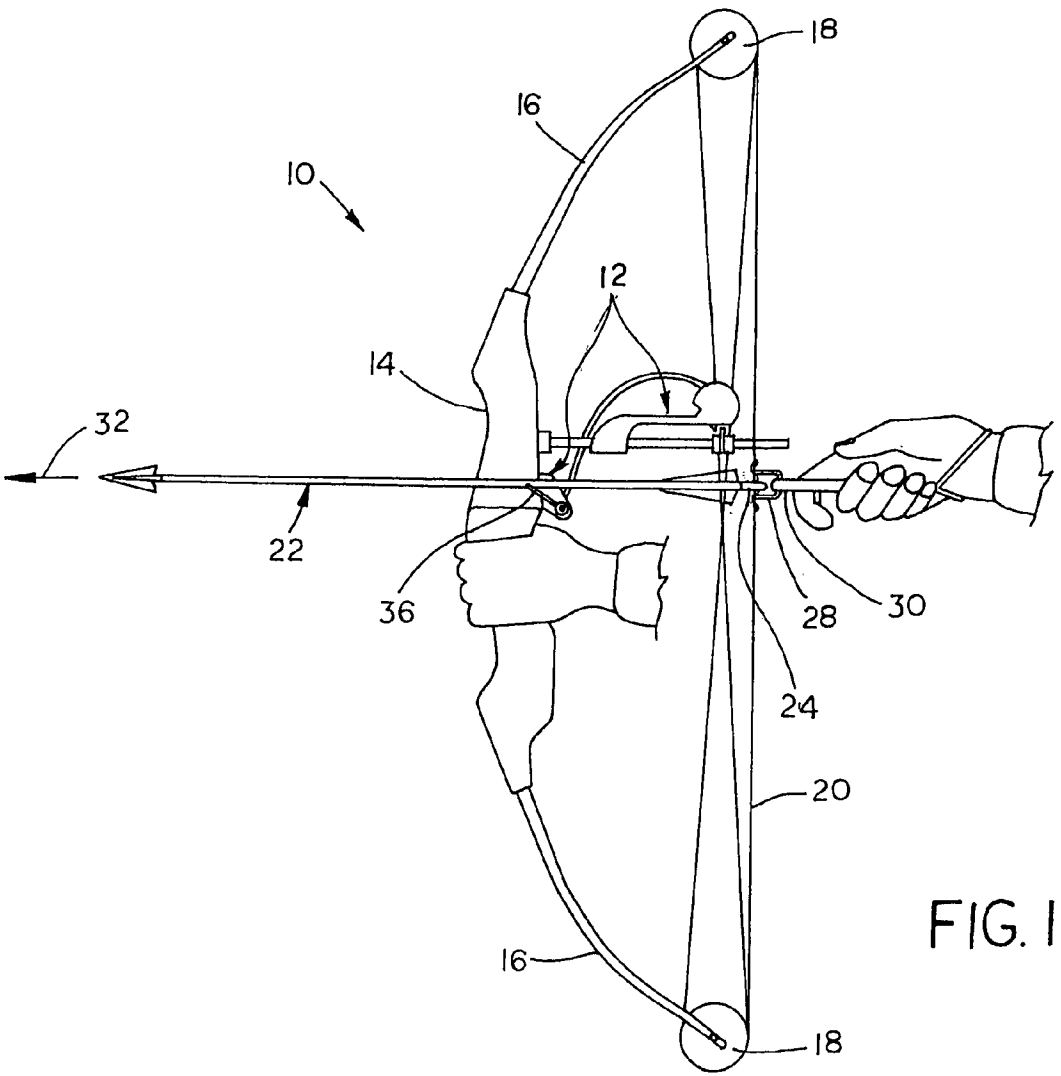
FIG. 1 is a side view of an archery bow of the present invention with the arrow rest platform in a raised support position, an arrow engaged with the bow string, and a hand release engaged with the nock set.

Referring now to the drawings, and more particularly to FIG. 1, there is shown an embodiment of an archery bow 10, incorporating an embodiment of an arrow rest assembly 12 of the present invention.

In the embodiment shown, bow 10 is a compound bow, but may be differently configured depending upon the application. For example, bow 10 may be a recurve or other type of bow. Bow 10 includes a riser 14 and a pair of flexible limbs 16 extending oppositely from riser 14. At the distal end of each limb 16 is a single rotating member 18, such as a pulley (as shown), or a cam wheel (not shown). At least one string 20 wraps around rotating members 18 and biases limbs 16 to a preloaded state.

Arrow rest assembly 12 is coupled with riser 14 and supports an arrow 22. Arrow 22 has a rear end with a nock 24 which is associated with a nock set 28 on string 20. Nock set 28 is engaged by a hand release 30 during use. Arrow 22 carried by arrow rest assembly 12 defines a trajectory plane (not numbered) associated with the trajectory path 32 of arrow 22. It will be appreciated that bow string 20 also lies within the trajectory plane of arrow 22. The trajectory plane may be adjusted somewhat by laterally adjusting arrow rest 12.

Arrow rest assembly 12 (FIGS. 4 and 5) includes a support body 34, arrow rest platform 36, a trigger sear including, e.g., first sear 38 and second sear 40, and resilient biasing device 42. Support body 34 is mounted to riser 14 using an adjustable slot 44 and screw 46.

Arrow rest platform 36 is movable between a raised support position (FIG. 4) supporting arrow 22, and a lowered position (FIG. 5) allowing free flight of arrow 22. Arrow rest platform 36 is shown having a plate or leaf shaped configuration with a notch in the distal end for supporting arrow 22. However, it will be appreciated that arrow rest platform 36 may be differently configured, such as a pair of pins with spaced apart distal ends supporting arrow 22, or other suitable configuration.

Pivot arm 50 extends through a transverse hole formed in support body 34. First sear 38 and corresponding set screw 58 maintain the longitudinal position of pivot arm 50 relative to support body 34.

Second sear 40 is carried by a rotary actuator which is pivotally coupled with support body 34. The rotary actuator includes a hub 60 coupled with a pendulum arm 62. Second sear 40 is coupled with pendulum arm 62 at an end opposite from hub 60. Hub 60 includes a hole 64 through which a screw 66 extends. Screw 66 is threadingly engaged with support body 34 and has a diameter slightly smaller than the inside diameter of hole 64 such that hub 60 is free to pivot about screw 66. Screw 66 may be formed with a shoulder or the like to limit the extent to which it may be screwed into the corresponding opening in support body 34.

First sear 38, and second sear 40 include mating shoulders which mate with each other when first sear 38 and second sear 40 are in the engaged position.

Resilient biasing device 42 is in the form of a spring in the embodiment shown. Spring 42 maintains first sear 38 and second sear 40 in an engaged position and in turn maintains arrow rest platform 36 in a raised support position, when first sear 38 and second sear 40 are engaged with each other. One end of spring 42 is coupled with set screw 58 and an opposite end of spring 42 is coupled with pendulum arm 62. The exact position and manner of attachment of spring 42 with pendulum arm 62 and/or first sear 38 may vary, depending upon the application. Moreover, spring 42 may be a tension spring, compression spring, leaf spring, etc.

Arrow rest assembly 12 also includes an actuator or trigger assembly 70 and trigger release 74 allowing timed release between first sear 38 and second sear 40, to in turn provide timed movement of arrow rest platform 36 to the lowered position. Trigger assembly 70 includes cantilever body 72, trigger 86, and cable 80. Trigger release 74 is incorporated into a slide 76 which slides along a cable guard arm 78.

Figure 4:
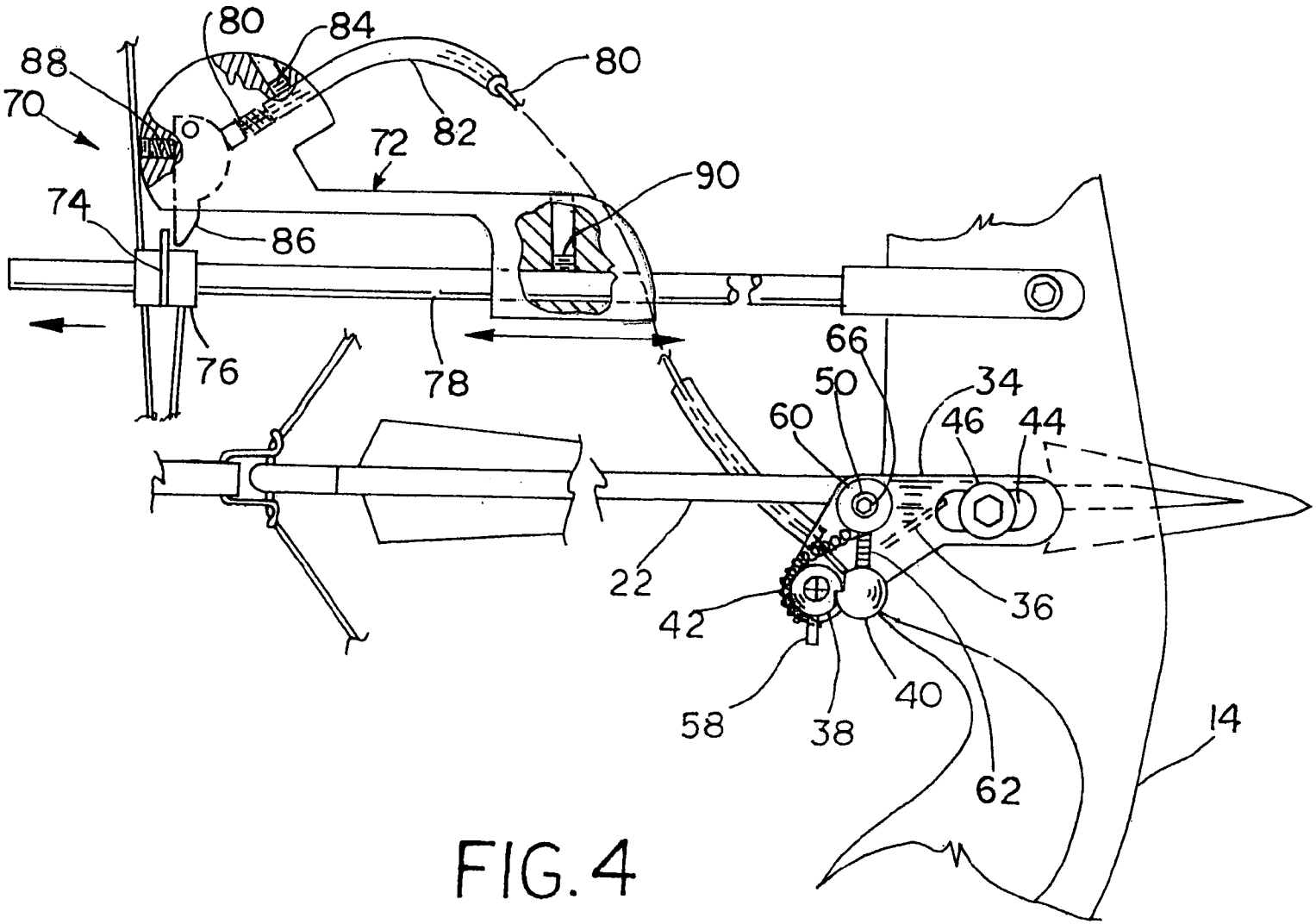
FIG. 4 is a side view of the arrow rest assembly when the arrow rest platform is in a raised support position.
Figure 5:
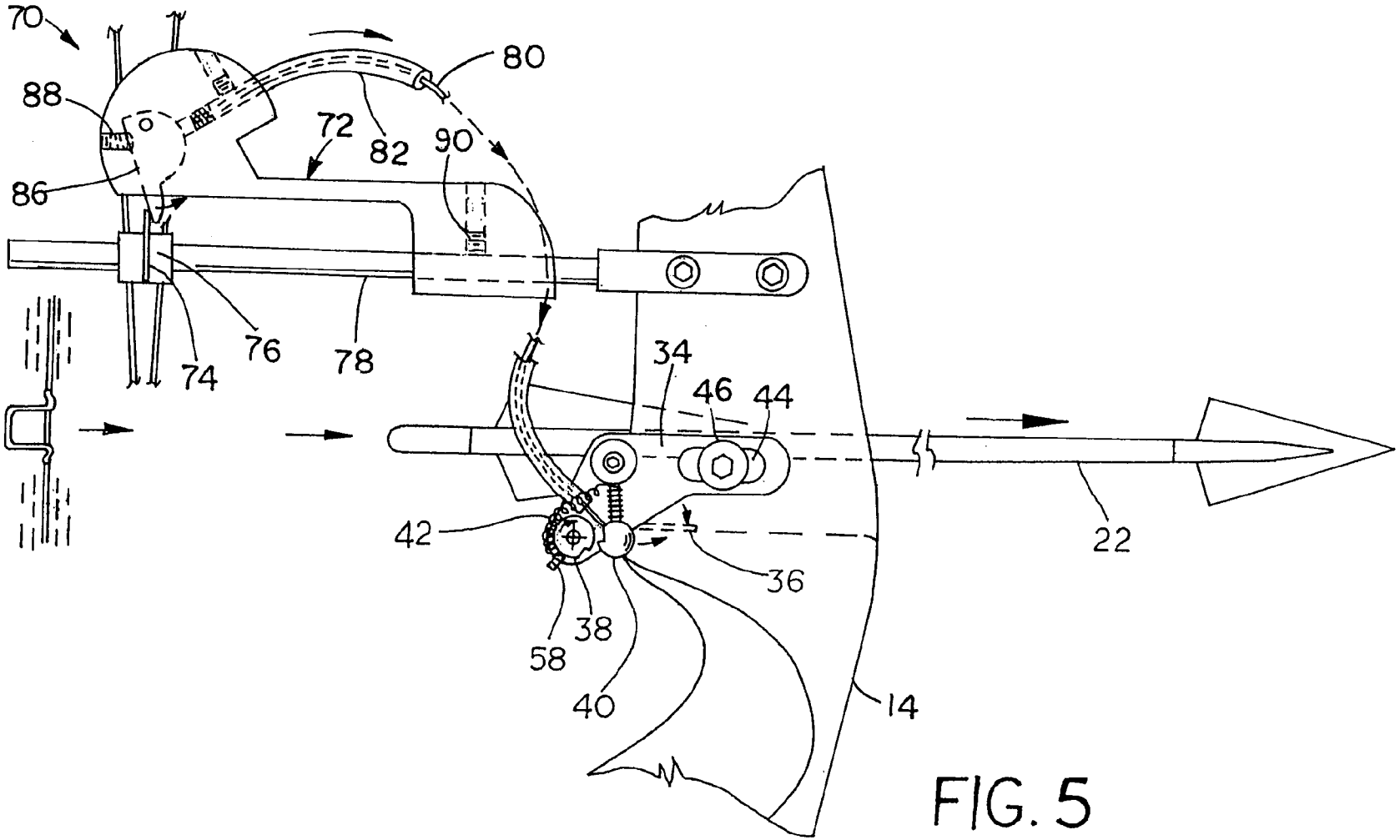
FIG. 5 is a side view of the arrow rest assembly when the arrow rest platform is in a lowered position.

Cantilever body 72 carries cable 80 which is axially movable within a cable sheath 82. Cable sheath 82 is inserted into cantilever body 72 and held in place using a set screw 84. One end of cable 80 is engagable with second sear 40 and an opposite end is engagable with a cammed trigger 86. A spring 88 biases trigger 86 to a non-activated, generally vertical position as shown in FIG. 4. When the bow is in a relaxed position, trigger release 74 is positioned to the right of trigger 86 shown in FIG. 4. As the bow is drawn, slide 76 and trigger release 74 engage against the right side of trigger 86 and rotate trigger 86 in a clockwise direction. The curvature at the upper end of trigger 86 is such that cable 80 is not moved. As trigger release 74 moves past trigger 86, spring 88 biases trigger 86 again to the vertical orientation shown in FIG. 4. Upon release of arrow string 20 (FIG. 5), trigger release 74 engages against the left side of trigger 86 and rotates trigger 86 in a counterclockwise direction as viewed in FIG. 5. Trigger 86 has a cam profile such that cable 80 is moved in an axial direction and releases second sear 40 from first sear 38. The timing at which trigger 86 is engaged by trigger release 74 may be easily adjusted by sliding cantilever body along cable guard arm 78 and tightening a set screw 90. Alternatively, cantilever body 72 may include two body parts which are adjusted relative to each other using coarse and/or fine adjustment screws. A return spring 92 (FIG. 6) biases cable 80 away from second sear 40.

Figure 2:
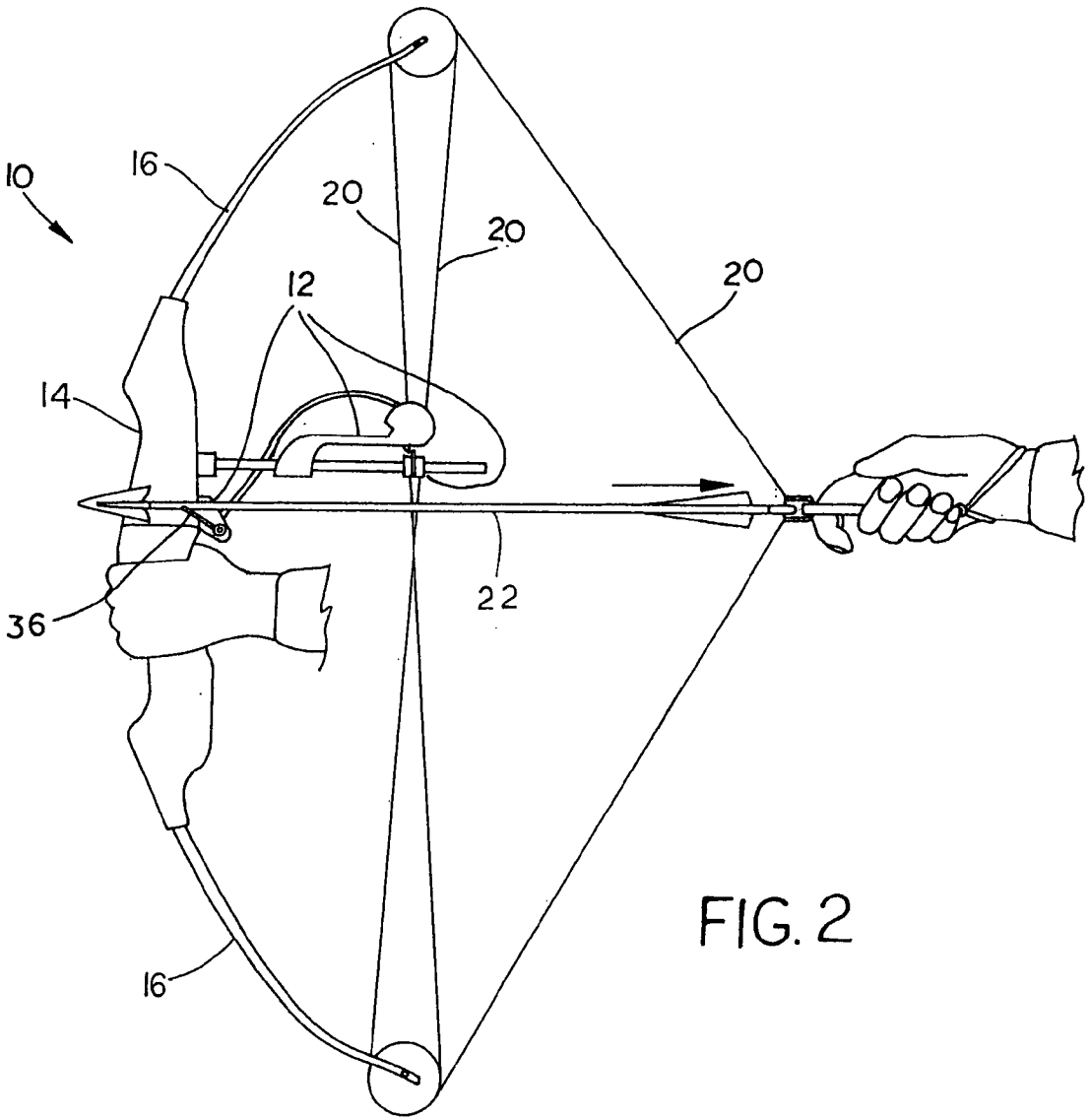
FIG. 2 is a side view of the archery bow of FIG. 1 when in the drawn position.
Figure 3:
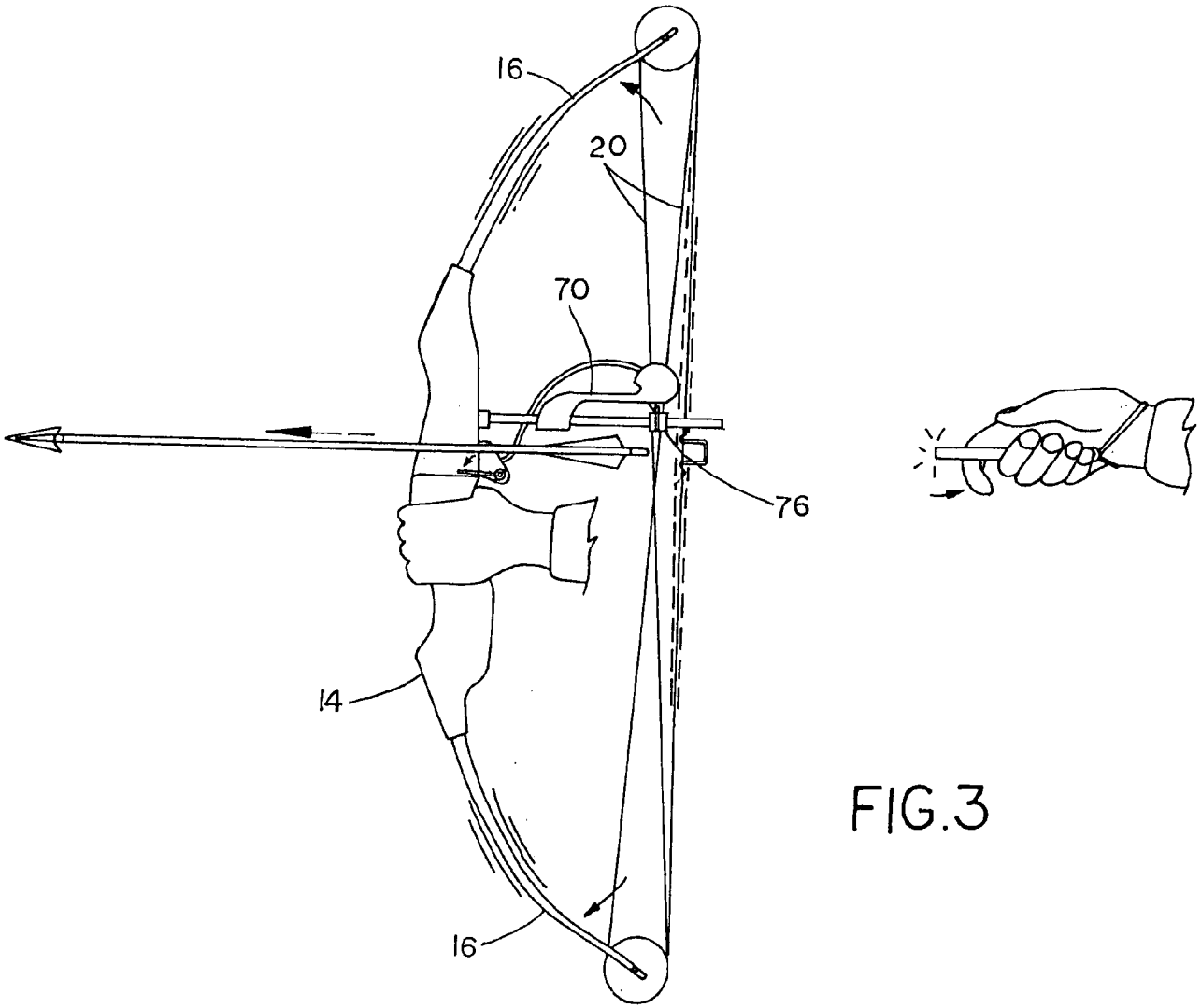
FIG. 3 is a side view of the archery bow of FIG. 1 upon release of the string from the hand release.
Figure 6:
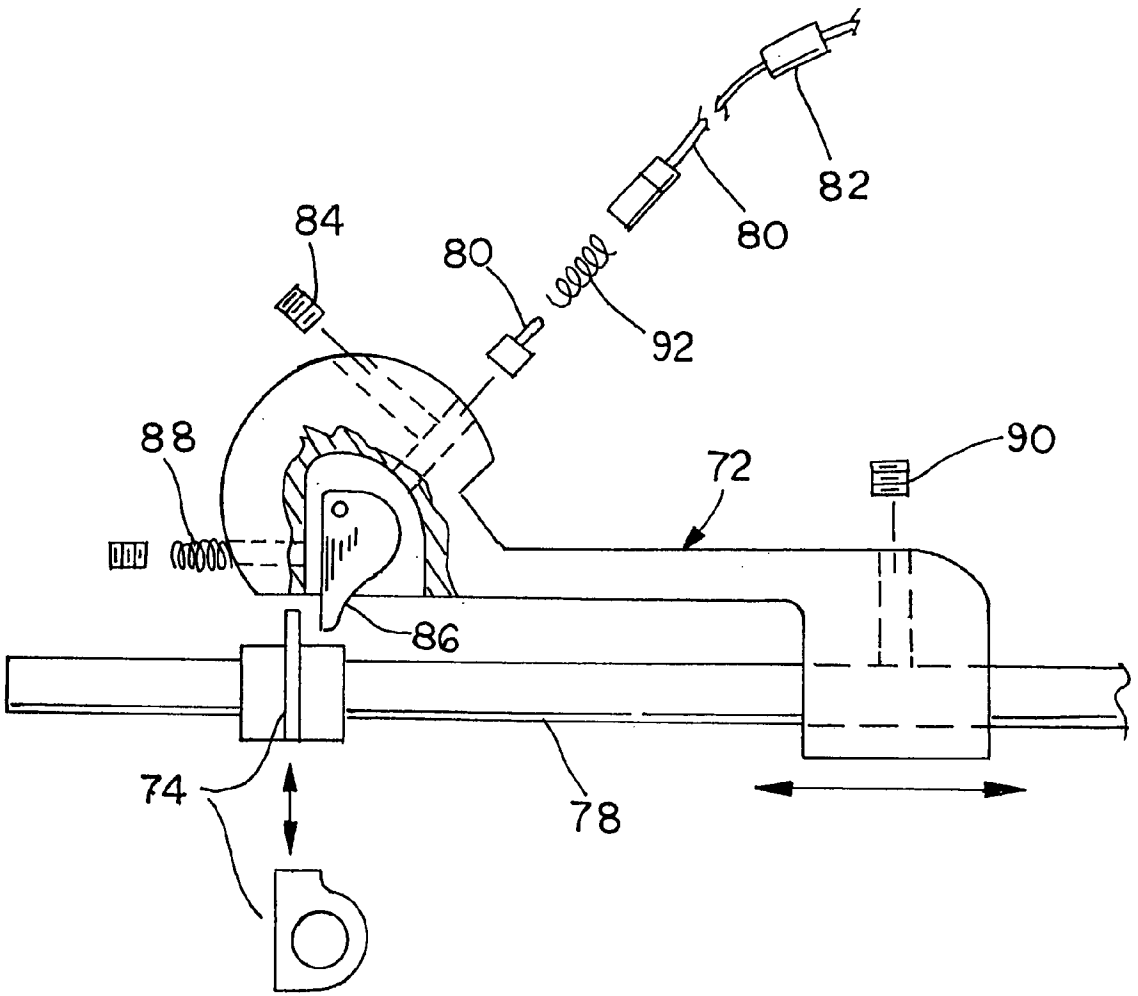
FIG. 6 is an exploded, perspective view of the trigger assembly and trigger release shown in FIGS. 1–5.

In use, if arrow rest platform 36 is already in the lowered position, then a user simply presses against set screw 58 with a thumb or finger to rotate arrow rest platform 36 to a raised support position. When arrow rest platform 36 is moved to the raised support position, first sear 38 and second sear 40 engage with each other at shoulders 68, 70 (FIGS. 4 and 6). Nock 24 of arrow 22 is then nocked onto string 20 at arrow nock location 26 within the confines of nock set 28. Arrow 22 is then placed on the raised arrow rest platform 36 (FIG. 1). Hand release 30 is engaged with nock set 28 so that bow 10 may be drawn to a fire position (FIG. 2). Hand release 30 is then activated so that string 20 is released. This results in forward motion of string 20 with which arrow 22 is engaged, and simultaneously results in return flexure of limbs 16 as arrow 22 moves along trajectory path 32. Trigger release 74 engages trigger 86, which axially moves cable 80 and disengages sears 38 and 40. When arrow rest platform 36 moves to the lowered position upon release of hand release 30, arrow rest platform 36 is entirely out of the flight path of arrow 22 and fletchings 72 so as to not interfere with the free flight of arrow 22.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An archery bow, comprising:

a riser;

a pair of flexible limbs extending from said riser, each said limb having a distal end;

at least one string extending between said limb distal ends and movable between a drawn position and a fired position;

a drop-away arrow rest mounted to said riser and movable between a raised position and a lowered position, said arrow rest biased to said lowered position and including a trigger sear for maintaining said arrow rest in said raised position;

a cable guard arm attached to and extending from said riser;

a trigger assembly carried by said cable guard arm and associated with said trigger sear; and a trigger release carried by and slidable along said cable guard arm, said trigger release being coupled with at least one said string, said trigger release engaging said trigger assembly and thereby disengaging said trigger sear upon movement of said at least one string from said drawn position to said fired position.

2. The archery bow of claim 1, wherein said trigger assembly includes a cantilever body attached to said cable guard arm, a trigger pivotally connected to said cantilever body, and a cable engageable with said trigger.

3. The archery bow of claim 2, wherein said trigger includes a cam surface for actuating said cable when said trigger release engages said trigger.

4. The archery bow of claim 3, wherein said trigger is biased to a non-actuated position.

5. The archery bow of claim 2, wherein said trigger assembly includes a set screw extending through said cantilever body for locking a position of said cantilever body relative to said cable guard arm.

6. The archery bow of claim 1, wherein said trigger release is defined by a wall extending from a slide, said slide being carried by and slidable along said cable guard arm.

7. The archery bow of claim 1, wherein said cable guard arm is rod shaped.

8. An arrow rest assembly for an archery bow having a riser and a cable guard arm attached to and extending from the riser, said arrow rest assembly comprising:

a drop-away arrow rest mountable to the riser and movable between a raised position and a lowered position, said arrow rest biased to said lowered position and including a trigger sear for maintaining said arrow rest in said raised position;

a trigger assembly mountable to the cable guard arm, said trigger assembly including a trigger; and a cable including a first end associated with said trigger and a second end disengaging said trigger sear upon actuation of said trigger.

9. The arrow rest assembly of claim 8, further including a trigger release mountable to the cable guard arm for engaging said trigger assembly.

10. A method of shooting an archery bow, comprising the steps of:

engaging a trigger sear of a drop-away arrow rest;

holding said arrow rest in a raised position when said trigger sear is engaged;

nocking an arrow on a bow string and placing the arrow on the arrow rest;

drawing and releasing the bow string;

engaging a trigger release with a trigger assembly, each of which are carried by a cable guard arm;

disengaging said trigger sear using a cable associated with each of said trigger assembly and said trigger sear; and moving said arrow rest to a lowered position.

11. The method of claim 10, including the step of adjusting a timing of said trigger assembly by adjusting a position of said trigger assembly relative to said cable guard arm.

12. The method of claim 11, wherein said trigger assembly includes a cantilever body and a set screw extending through said cantilever body for locking a position of said cantilever body relative to said cable guard arm.

13. The method of claim 10, wherein said trigger assembly includes a cantilever body attached to said cable guard arm, a trigger pivotally connected to said cantilever body, and said cable.

14. The method of claim 13, wherein said trigger includes a cam surface for actuating said cable when said trigger release engages said trigger.

* * * * *